US010840647B2

(12) United States Patent
Figie

(10) Patent No.: US 10,840,647 B2
(45) Date of Patent: Nov. 17, 2020

(54) PCB MOUNTED CONNECTOR WITH TWO-PIECE SHIELD FOR IMPROVED ESD TOLERANCE

(71) Applicant: Rockwell Automation Technologies, Inc., Mayfield Heights, OH (US)

(72) Inventor: John R. Figie, Germantown, WI (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 0 days.

(21) Appl. No.: 16/433,413

(22) Filed: Jun. 6, 2019

(65) Prior Publication Data

US 2019/0379164 A1 Dec. 12, 2019

Related U.S. Application Data

(60) Provisional application No. 62/682,593, filed on Jun. 8, 2018.

(51) Int. Cl.
*H01R 13/6581* (2011.01)
*H01R 13/6594* (2011.01)
*H01R 13/648* (2006.01)

(52) U.S. Cl.
CPC ..... *H01R 13/6581* (2013.01); *H01R 13/6485* (2013.01); *H01R 13/6594* (2013.01)

(58) Field of Classification Search
CPC ..... H01R 13/6581; H91R 13/648
USPC ..... 439/607.4, 607.55
See application file for complete search history.

(56) References Cited

U.S. PATENT DOCUMENTS 4,337,989 A * 7/1982 Asick ..... H01R 13/6595 174/359
5,637,014 A * 6/1997 Sukegawa ..... H01R 23/6873 439/607.4
6,210,226 B1 * 4/2001 Zhu ..... H01R 24/64 439/607.4
6,561,849 B2 * 5/2003 Naito ..... H01R 13/6594 439/607.4
6,595,801 B1 7/2003 Leonard et al.
6,755,689 B2 * 6/2004 Zhang ..... H01R 12/716 439/357
6,786,770 B1 * 9/2004 Huang ..... H01R 13/6596 439/607.55

(Continued)

*Primary Examiner* — Neil Abrams
(74) *Attorney, Agent, or Firm* — Fay Sharpe LLP

(57) ABSTRACT

A shielded connector includes a body with a socket adapted to receive a cable termination plug. Connector contacts in the socket mate with contacts of the cable plug. Connector pins project from the body and are operably coupled to the connector contacts in the socket. An electrically conductive shield covers part of the body and includes (i) a first shield part; and (ii) a second shield part physically disconnected from the first shield part and electrically isolated from the first shield part such that an open space separates the first shield part from the second shield part. The first shield part includes a cable shield contact located adjacent the socket that electrically mates with the EMI shield termination contact of the plug. The first and second shield parts further include respective first and second shield connector pins to physically and electrically connect the shield with an associated printed circuit board for dissipation of electrical charges from the first and second shield parts.

18 Claims, 5 Drawing Sheets

(56) References Cited

U.S. PATENT DOCUMENTS

| | | | | |
|---|---|---|---|---|
| 7,748,999 | B1 * | 7/2010 | Sun | H01R 12/716 439/79 |
| 7,931,497 | B2 * | 4/2011 | Yang | H01R 13/6594 439/362 |
| 8,257,100 | B2 * | 9/2012 | Lu | H01R 12/724 439/188 |
| 8,523,602 | B2 | 9/2013 | Figie | |
| 8,632,362 | B2 * | 1/2014 | Straka | H01R 13/516 439/607.38 |
| 8,657,628 | B2 * | 2/2014 | Xie | H01R 13/6583 439/607.1 |
| 8,939,777 | B2 * | 1/2015 | Lin | H01R 43/16 439/79 |
| 9,011,176 | B2 * | 4/2015 | Tziviskos | H05K 5/0247 439/607.4 |
| 2019/0379164 | A1 * | 12/2019 | Figie | H01R 13/648 |

* cited by examiner

PCB MOUNTED CONNECTOR WITH TWO-PIECE SHIELD FOR IMPROVED ESD TOLERANCE

CROSS-REFERENCE TO RELATED APPLICATION

This application claims priority from and benefit of the filing date of U.S. provisional application Ser. No. 62/682,593 filed Jun. 8, 2018, and the entire disclosure of said provisional application is hereby expressly incorporated by reference into the present specification.

BACKGROUND INFORMATION

The subject matter disclosed herein relates to shielded connectors for being mounted to a printed circuit board (PCB) to provide a termination for the cable electromagnetic interference (EMI) shield when the cable termination plug is mated with the socket of the shielded connector. PCB mounted RJ45 socket connectors for Industrial Ethernet are one such type of known shielded connector. Unfortunately, these known connector shields also provide a pathway for high frequency electrical noise to be conducted on the inside of the connector shield in response to an electrostatic discharge (ESD) or other source. These high frequency noise currents and voltages on the inside of the connector shield can sometimes couple to and interfere with data signals internal to the connector. Such coupling of the electrical noise to the internal connector data signals lowers the system immunity to electrical noise, especially ESD noise. Mitigation of the ESD coupled noise into the system associated with the shielded connector is difficult without also disrupting or slowing the communications provided by the data signals in the connector socket.

In addition, known connector shield in industrial equipment is often intentionally not connected in a DC path to the chassis so as to avoid ground currents through the equipment. This intentional breaking of the DC ground path connection leads to increased coupling of the noise to the communication (information) signals in the shielded connector because of unwanted "parasitic" inductance in the coupling network. Typically, the noise voltages coupled to the information signals are suppressed with small capacitors and transient absorbing diodes, but suppressing the noise in this manner with electronic elements connected to the signals undesirably degrades high speed communications signals. Thus, a need has been identified for a new and improved shielded connector that overcomes these and other deficiencies of known shielded connector sockets.

FIGS. 1 and 2 (prior art) are respective top and bottom isometric views of a typical known shielded PCB mounted connector (shown as an RJ45 connector) C'. The connector C' comprises a body B' including parallel, spaced-apart front and rear walls FW', RW' located opposite each other, parallel and spaced-apart first and second side walls SW1',SW2' located on opposite lateral sides of the body B', and parallel, spaced-apart top and bottom walls TW',BW'. The body B' can be defined from a polymeric material and be electrically non-conductive. When the connector C' is operatively installed on a printed circuit board PCB, the bottom wall BW' (sometimes also referred to as a "base") of the connector C' is abutted with the printed circuit board PCB.

The body B' includes an open socket CS' defined therein that includes a mouth M' that opens through the front wall FW' and that is adapted to receive a mating plug of an associated cable or other associated device. The socket CS' includes one or multiple electrically conductive connector contacts CC' located therein that mate with corresponding electrically conductive pins or contacts of the mating cable plug (not shown). The connector C' includes hard-wired (directly wired) connections and/or additional internal connection circuitry, such as transformers or the like (sometimes referred to as "integrated magnetics"), one or more printed circuit boards (PCB), and/or integrates other discrete components that operably couple the connector contacts CC' to the printed circuit board PCB via respective connector pins PN' (FIG. 2) that project outwardly from and through the bottom wall BW' for conducting data and/or power signals between the connector contacts CC' and the printed circuit board PCB through the connector pins PN'. The connector C' can also include light emitting diodes LEDs to provide visual indicia of status or other conditions to a user or service technician.

The connector C' includes an external electrically conductive metallic shield S' that completely or at least substantially completely covers the exposed portions of the connector body B' not abutted with the printed circuit board PCB. In particular, the shield S' is abutted with and covers the remaining portions of the front wall FW' not removed to form the socket CS', the rear wall RW', the first and second side walls SW1',SW2', and the top wall TW'. The shield S' is defined from a suitable electrically conductive metal material such as plated steel, stainless steel, copper or copper alloys, aluminum or alloys of same, brass, or any other electrically conductive metal material.

The shield S' includes at least one cable shield contact TB', such as a tab or pin or the like, connected thereto and located adjacent the socket (preferably projecting into the hollow interior of socket CS' through the open mouth M') adjacent at least one of the body side walls SW1',SW2'. Each such cable shield contact TB' is adapted to mate electrically with a cable electromagnetic interference (EMI) shield termination contact provided as part of the associated cable termination plug mated with the connector socket CS' such that the connector shield S' is directly electrically coupled with the EMI shield of the associated cable.

The shield S' also includes one or more shield connector tabs or pins SP' connected thereto and projecting outwardly therefrom for physically and electrically connecting the shield S' to the printed circuit board PCB. More specifically, the shield connector pins SP' connect the shield S' with a ground path such as a ground path provided through the printed circuit board PCB, such as a direct or network (indirect) ground path connection to an earth ground, chassis ground, or other ground or common point in the system, for dissipation of any electrical charges in the shield S' through the shield connector pin SP'. A "network" ground path includes discrete electronic components that provide an indirect ground path for isolation to prevent a DC ground path to chassis ground.

As noted above, the known connector shield S' can sometimes allow high frequency electrical noise to be electromagnetically coupled between the connector shield S' and the connector contacts CC' and other circuitry located inside the connector C'. The high frequency electrical noise can be originated by an electrostatic discharge (ESD) from the EMI shield of the associated cable mated with the connector C' that enters the shield S' through the cable shield contact TB' or the high frequency electrical noise can be originated from another electromagnetic phenomenon. These high frequency noise currents and voltages on the inside of the connector shield S' can sometimes couple to and interfere with data signals on the connector contacts CC' or otherwise internal to the connector socket which is undesired and suboptimal.

SUMMARY

In accordance with one aspect of the present development, a shielded connector includes a body with a socket adapted to receive a cable termination plug. Connector contacts in the socket mate with contacts of the cable plug. Connector pins project from the body and are operably coupled to the connector contacts in the socket. An electrically conductive shield covers part of the body and includes (i) a first shield part; and (ii) a second shield part physically disconnected from the first shield part and electrically isolated from the first shield part such that an open space separates the first shield part from the second shield part. The first shield part includes a cable shield contact located adjacent the socket that electrically mates with the EMI shield termination contact of the plug. The first and second shield parts further include respective first and second shield connector pins to physically and electrically connect the shield with an associated printed circuit board for dissipation of electrical charges from the first and second shield parts.

In accordance with another aspect of the present development, a shielded connector includes a body connected to a printed circuit board. The body includes a front wall, a rear wall, a top wall, a bottom wall, a first side wall, and a second side wall, wherein said bottom wall is abutted with the printed circuit board and the body includes an open socket defined therein that opens through a mouth defined in the front wall. The socket is adapted for receiving an associated cable termination plug of an associated cable. A plurality of connector contacts are located in the socket and are adapted to mate with corresponding contacts of the associated cable termination plug. A plurality of connector pins project outwardly from the body and are respectively operably coupled to the plurality of connector contacts. The connector pins are electrically connected to said printed circuit board. An electrically conductive metallic shield is connected to the body and includes: (i) a first shield part; and (ii) a second shield part that is physically disconnected from the first shield part and that is electrically isolated from the first shield part such that an open space separates the first shield part from the second shield part. The first shield part is located adjacent the mouth of the socket and includes at least one cable shield contact located adjacent the socket that is adapted to mate electrically with an electromagnetic interference (EMI) shield termination contact of the associated cable termination plug for directly electrically coupling the first shield part to the EMI shield of the associated cable. The second shield part covers at least part of the rear wall, at least part of said top wall, and at least part of the first and second side walls of said body. The first and second shield parts further include respective first and second shield connector pins connected to the printed circuit board for dissipating electrical charges from said first and second shield parts through the printed circuit board.

In accordance with another aspect of the present development, a shielded connector includes a body with a socket including a plurality of connector contacts located in the socket, wherein the socket is adapted to receive an associated cable plug and the plurality of connector contacts located in the socket are adapted to mate respectively with a plurality of corresponding plug contacts of the associated cable plug. A plurality of connector pins projecting outwardly from the body and are operably connected to the plurality of connector contacts, respectively. An electrically conductive metallic shield covers at least part of the body. The shield includes: (i) a first part; and (ii) a second that is physically disconnected and electrically isolated from the first of the shield such that an open space separates the first part of the shield from the second part of the shield. The first part of the shield is located adjacent the socket, and the second part of the shield is abutted with and covers at least part of the body. The open space that separates the first and second parts of the shield exposes at least part of said body. The body comprises opposite front and rear walls, opposite first and second side walls, and opposite top and bottom walls, wherein said socket is defined in said front wall and wherein said open space extends from a first end located adjacent a first intersection where said first side wall intersects said bottom wall to a second end located adjacent a second intersection where said second side wall intersects said bottom wall.

DETAILED DESCRIPTION OF THE PRESENT DEVELOPMENT

Figure 3A:
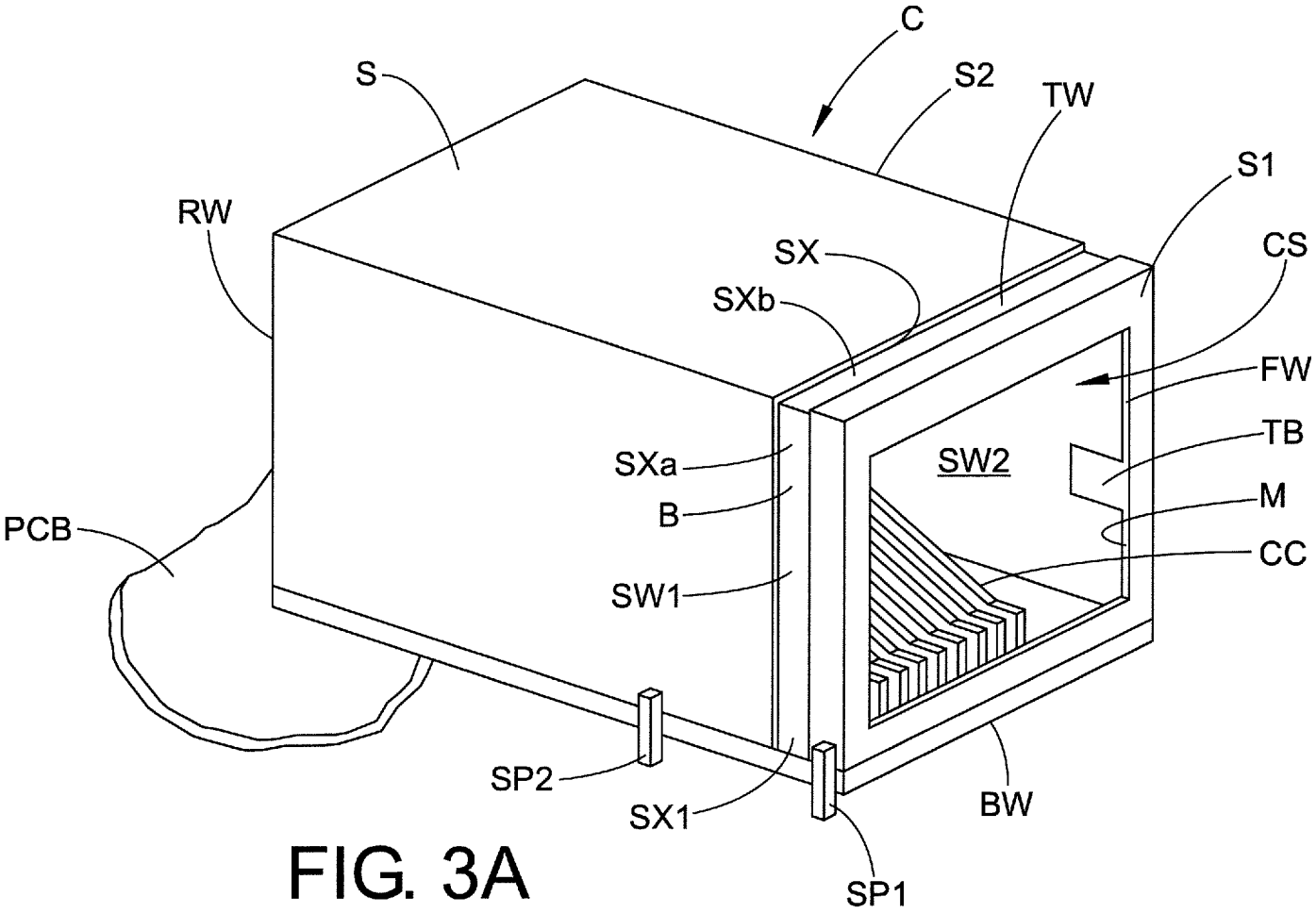
FIGS. 3A and 3B (collectively "FIG. 3") are respective left and right top isometric views of a PCB mounted connector C provided in accordance with one embodiment of the present development.
Figure 3B:
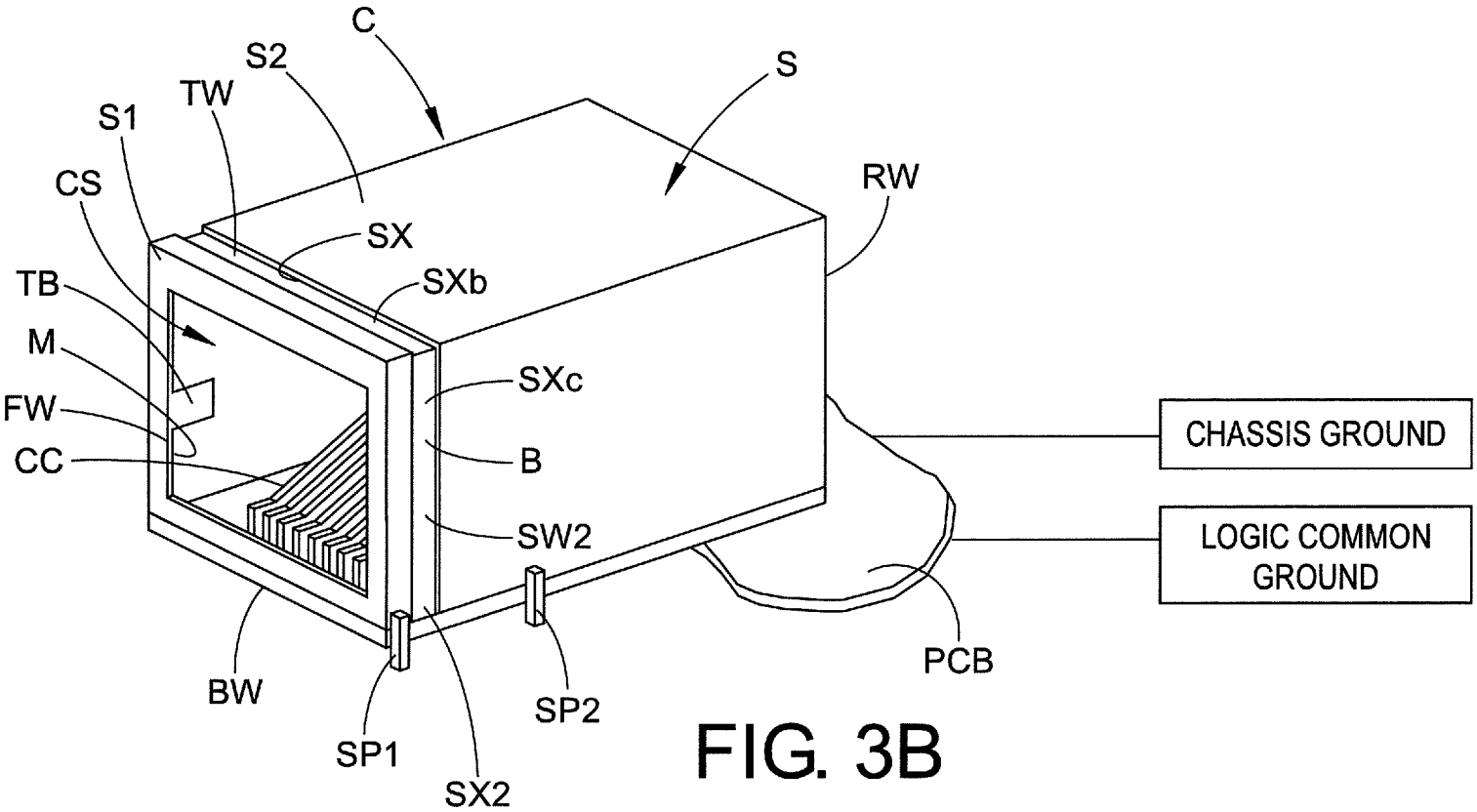
Figure 4A:
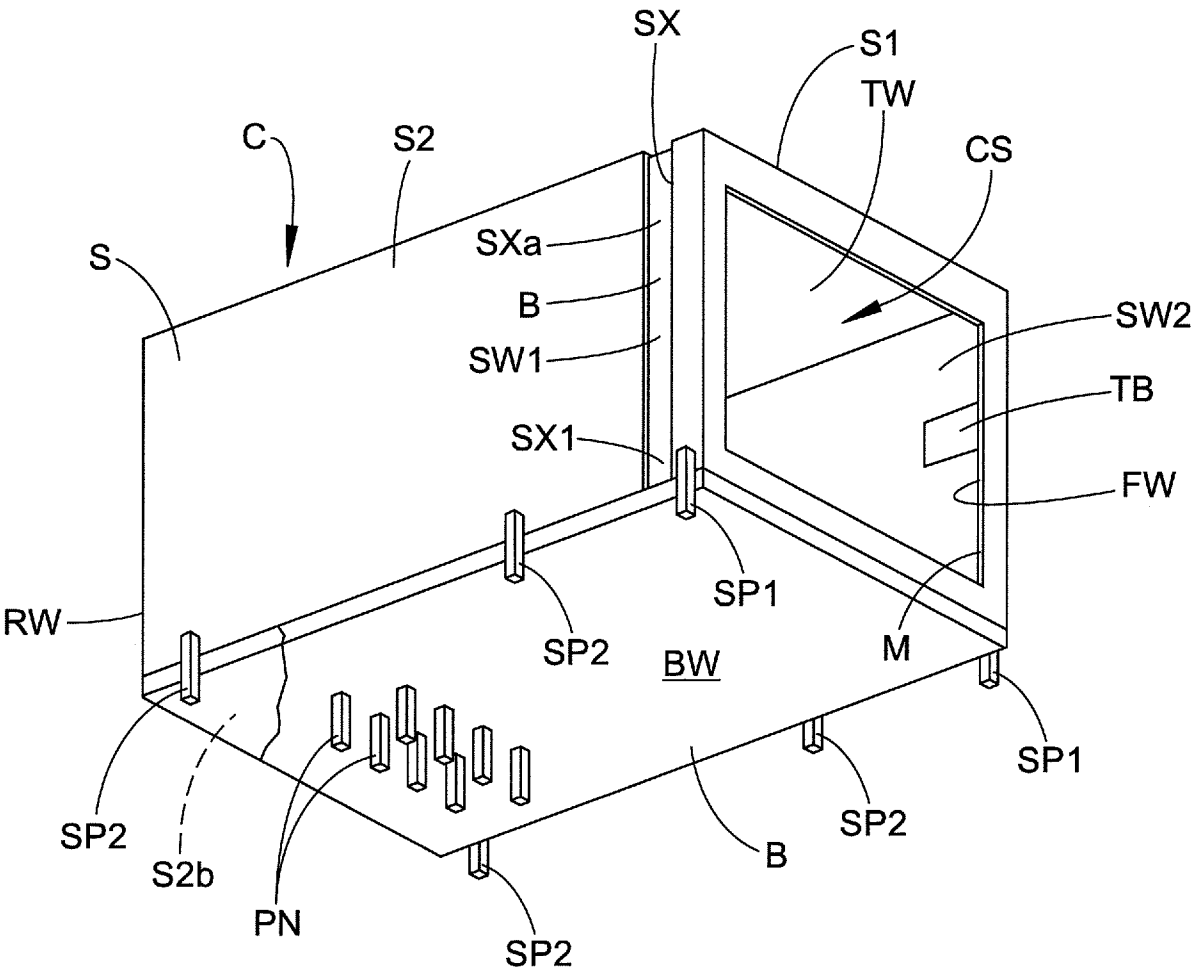
FIGS. 4A and 4B (collectively "FIG. 4") are respective left and right bottom isometric views of a the connector C.
Figure 5:
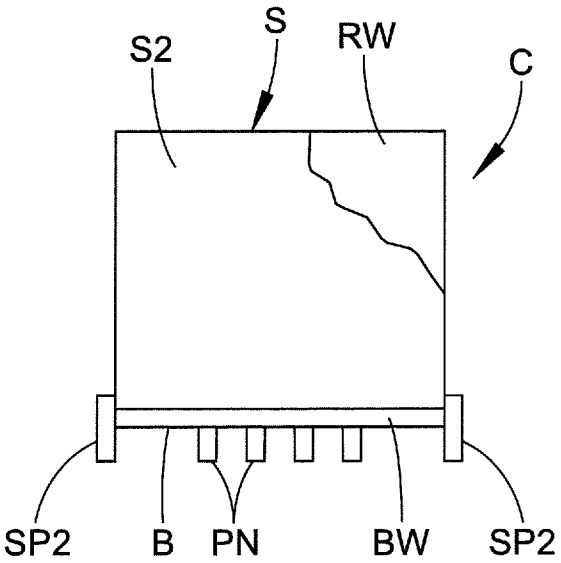
FIG. 5 is a rear elevational view of the connector C, with a portion of the shield removed to reveal the rear wall RW.
Figure 4B:
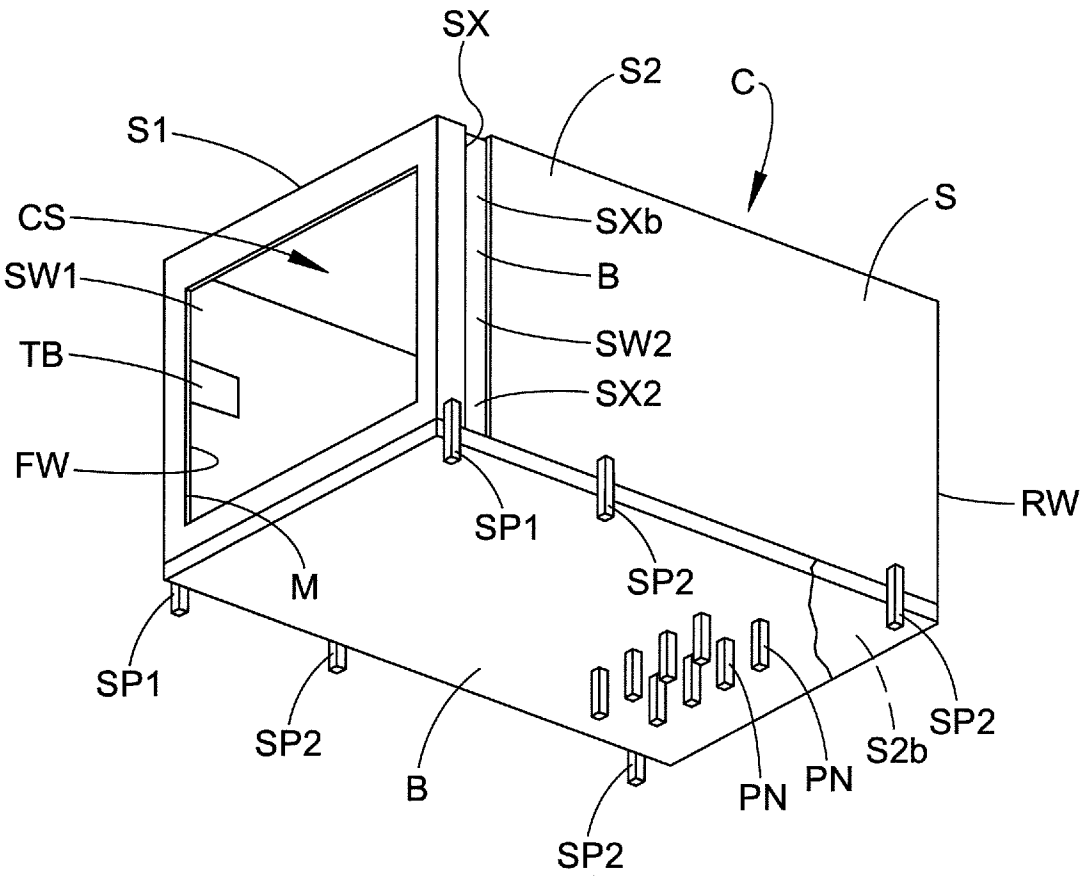

FIGS. 3A and 3B (collectively "FIG. 3") are respective left and right top isometric views of a PCB mounted connector C provided in accordance with one embodiment of the present development. FIGS. 4A and 4B (collectively "FIG. 4") are respective left and right bottom isometric views of a the connector C. FIG. 5 is a rear elevational view of the connector C, with a portion of the shield removed to reveal the rear wall RW. Similar to the known connector C', a connector C according to the present invention comprises a body B including parallel, spaced-apart front and rear walls FW, RW located opposite each other, parallel and spaced-apart first and second side walls SW1,SW2 located on opposite lateral sides of the body B, and parallel, spaced-apart top and bottom walls TW,BW. The body B can be defined as one-piece from a polymeric material and be electrically non-conductive. When the connector C is operatively installed on a printed circuit board PCB, the bottom wall BW (sometimes also referred to as a "base") of the connector C is abutted with the printed circuit board PCB as shown on FIG. 3.

Figure 2:
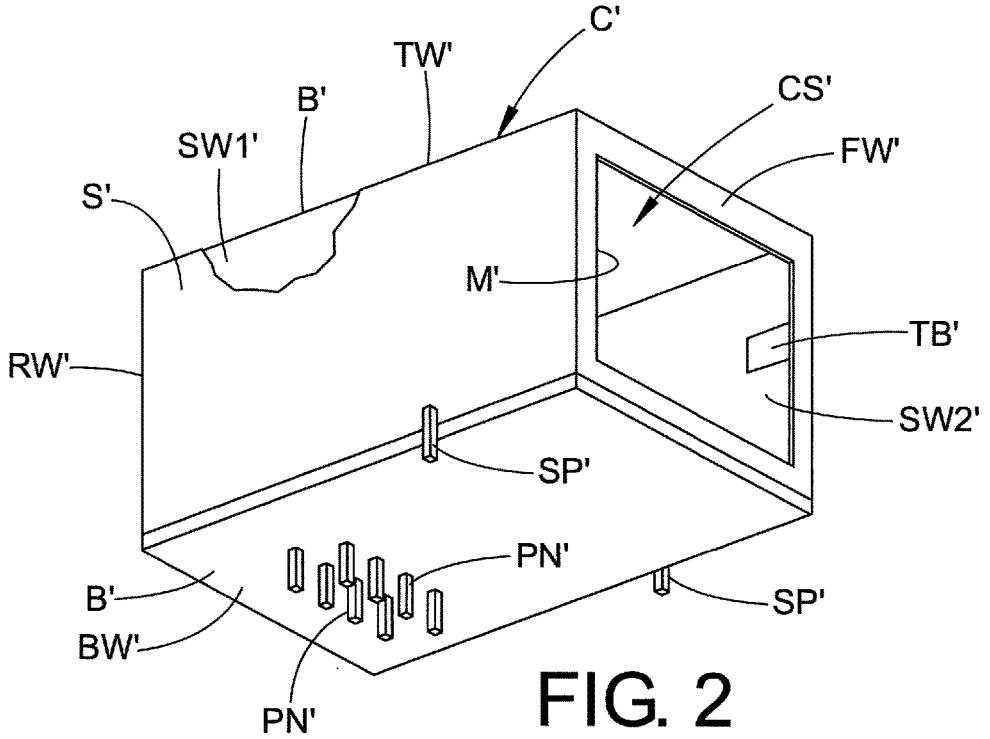
FIG. 2 (Prior Art)

The body B includes an open socket CS defined therein that includes a mouth M that opens through the front wall FW and that is adapted to receive a mating plug of an associated cable or other associated device. The socket CS includes one or multiple electrically conductive connector contacts CC located therein that mate with corresponding electrically conductive pins or contacts of the mating cable plug (not shown). The connector C includes hard-wired (directly wired) connections and/or additional internal connection circuitry, such as transformers or the like (sometimes referred to as "integrated magnetics"), one or more printed circuit boards (PCB), and/or integrates other discrete components that operably couple the connector contacts CC to the printed circuit board PCB via respective connector pins PN (FIG. 2) that project outwardly from and through the bottom wall BW for conducting data and/or power signals between the connector contacts CC and the printed circuit board PCB through the connector pins PN. The connector C can also include light emitting diodes LEDs to provide visual indicia of status or other conditions to a user or service technician.

Figure 1:
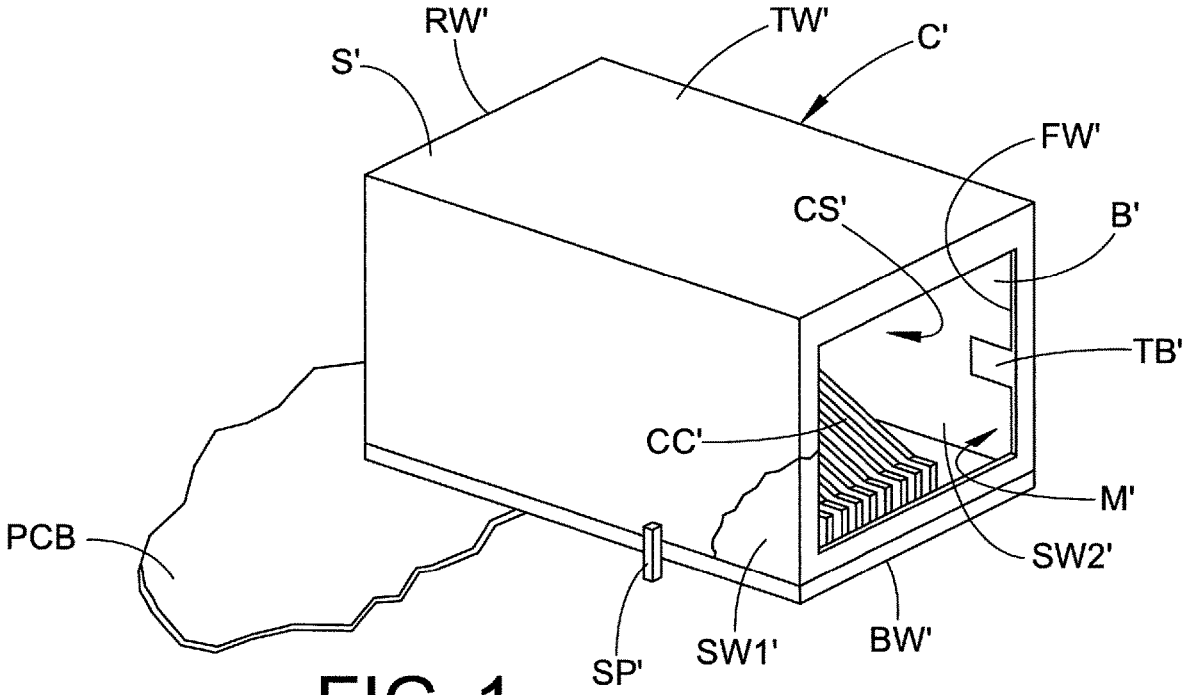
FIG. 1 (Prior Art)
FIGS. 1 and 2 (prior art) are respective top and bottom isometric views of a typical known shielded PCB mounted connector C' with portions of the shield S' removed to reveal the body B'.

According to one aspect of the present development, a PCB mounted connector C, such as the illustrated RJ45 connector or the like, includes a two-piece EMI/ESD shield S. Unlike known one-piece connector shields S' described above in relation to FIGS. 1 &2, a connector shield S formed in accordance with the present invention includes two separate parts: (i) a first or front part S1; and (ii) a second or rear part S2 that is electrically isolated from the first or front part S1 of the shield S. A gap or open space SX separates the first part S1 of the shield S from the second part S2 of the shield such that the first and second parts S1,S2 are physically and electrically disconnected from each other. The gap SX defined between the first and second shield parts S1,S2 exposes portions of at the first and second side walls SW1,SW2 and a portion of the top wall TW of the connector body B. The connector C can be provided with or without integrated magnetics, a printed circuit board, and/or other discrete electronic components for electrically and/or operably connecting the connector contacts CC to respective connector pins PN.

As described in more detail below, the first part of the shield S1 provides a termination for the cable EMI shield to earth or chassis ground in the system (see FIG. 3B). The chassis ground path may be direct or may be connected using a network of discrete electronic components to provide isolation. The second part of the connector shield S2 shields the remaining part of the connector from EMI (electromagnetic interference). The first (front) and second (rear) parts S1,S2 of the shield S are electrically isolated with respect to each other.

The metallic shield S of the connector C substantially completely covers the exposed portions of the connector body B not abutted with the printed circuit board PCB, except for the space SX defined between the first and second parts S1,S2 of the shield S in order for the shield to provide effective EMI shielding capabilities. Together, the first and second parts S1,S2 of the shield S cover substantially all of the exposed surfaces of the connector body B to provide effective EMI shielding, i.e., the first and second parts S1,S2 of the shield S cover substantially all of the parts of the connector body B not abutted with the printed circuit board PCB (but the second part S2 of the shield S can optionally additionally cover part or all of the bottom wall BW and/or other part of the connector body B that is abutted with the printed circuit board PCB to which the connector C is mounted) to provide additional EMI shielding to the connector body B.

The first (front) part S1 of the shield is located adjacent the mouth M of the socket CS. As shown in the illustrated embodiment, the first part S1 of the shield is abutted with and covers the remaining portions of the front wall FW not removed to form the mouth M of the socket CS and also covers portions of the top wall TW and first and second side walls SW1,SW2 that are located adjacent the front wall FW. The second (rear) part S2 of the shield is abutted with and covers the entire rear wall RW (see also FIG. 5), and a majority of the first and second side walls SW1,SW2, and also a majority of the top wall TW. Together, the first and second shield portions S1,S2 cover a substantial majority (at least 85%) of an exposed surface area of the connector body B defined by the top wall TW, the rear wall RW, and the first and second side walls SW1,SW2. The first and second parts of the shield S are each defined from a suitable electrically conductive metal material such as plated steel, stainless steel, copper or copper alloys, aluminum, brass, or any other electrically conductive metal material.

The first part of the shield S1 includes at least one cable shield contact TB, such as a tab or pin or other electrical contact, connected thereto and located adjacent the socket CS (preferably projecting into the hollow interior of socket CS through the open mouth M) or otherwise located near the socket CS adjacent one of the side walls SW1,SW2 or located elsewhere adjacent the socket CS. Each such cable shield contact TB is adapted to abut and mate electrically with a cable electromagnetic interference (EMI) shield termination contact provided on the associated cable termination plug that is mated with the connector socket CS such that the first part S1 of the connector shield S is directly electrically coupled with the EMI shield of the associated cable. The first part S1 of the shield S also includes one or more shield connector tabs or pins SP1 or another electrical contact or contact location for physically and electrically connecting the first part S1 to the printed circuit board PCB in order to connect the shield S to an earth or chassis ground path of the printed circuit board PCB or another ground path in the system. As noted above, the earth or chassis ground path of the printed circuit board PCB can be a direct (hard-wired) connection or an indirect "network" connection through discrete electronic components to provide isolation.

The second part S2 of the connector shield S shields the remaining part of the connector body B from EMI (electromagnetic interference). The second part S2 of the shield S also includes one or more shield connector tabs or pins SP2 or another electrical contact for physically and electrically connecting the second part S2 of the shield S to the printed circuit board PCB so that the second shield part S2 is electrically connected with a common point such as a logic common plane of the printed circuit board PCB to dissipate EMI charges from the shield second part S2 into the logic common plane or other "ground path" of the printed circuit board (see FIG. 3B). Preferably, the shield connector pins SP1,SP2 of the first and second shield parts S1,S2 are connected to different, distinct ground paths (i.e., not commonly connected), for example, with the first shield part S1 connected to an earth ground path or a chassis ground path and the second shield part S2 connected to a logic common connection of the printed circuit board. In the illustrated embodiment, the second part S2 of the shield S does not extend over or cover the bottom wall BW of the connector body B, but the second part S2 of the shield S can alternatively be structured to cover all or part of the entire bottom wall BW of the connector C by extending between the bottom wall BW and the printed circuit board PCB (as partially shown at S2*b* in FIG. 4) to provide additional EMI shield protection to the connector body B. In one embodiment, the printed circuit board PCB is constructed such that the logic common plane of the printed circuit board PCB extends beneath or covers at least part or all of the bottom wall BW of the connector body B to provide additional EMI shielding to the connector body B.

The portion of the side walls SW1,SW2 and top wall TW located in the space SX are preferably the only portions of the side walls SW1,SW2 and top wall TW that are not covered by the shield S. In one preferred embodiment that has been found to provide beneficial results, the open space SX separating the first and second shield portions S1,S2 extends from a first end SX1 located adjacent a first intersection where said body first side wall SW1 intersects said bottom wall BW to a second end SX2 located adjacent a second intersection where said second side wall SW2 intersects said bottom wall BW. More particularly, the open space SX comprises: (i) a first leg SXa that extends from said first end SX1 across said first body side wall SW1; (ii) a second leg SXb that extends from said first leg SXa across said body top wall TW; and, (iii) a third leg SXc that extends across said body second side wall SW2 from said second leg SXb to said second end SX2 such that said open space SX extends continuously and uninterruptedly from said first end to said second end. Preferably, the first and second third legs SXa,SXc are arranged parallel with respect to each other and each is perpendicular to the second (middle) leg SXb, and the second (middle) leg SXb is arranged parallel to the bottom wall BW and perpendicular to the side walls SW1, SW2.

In the preceding specification, various embodiments have been described with reference to the accompanying drawings. It will, however, be evident that various modifications and changes may be made thereto, and additional embodiments may be implemented, without departing from the broader scope of the invention as set forth in the claims that follow. The specification and drawings are accordingly to be regarded in an illustrative rather than restrictive sense.

The invention claimed is:

1. A shielded connector comprising:

a body comprising a socket adapted to receive an associated cable termination plug of an associated cable;

a plurality of connector contacts located in the socket and adapted to mate with corresponding contacts of the associated cable termination plug;

a plurality of connector pins projecting outwardly from the body and respectively operably coupled to the plurality of connector contacts for transmission of electronic data between the connector contacts and the connector pins;

an electrically conductive shield covering at least part of the body, the shield comprising: (i) a first shield part; and (ii) a second shield part that is physically disconnected from the first shield part and that is electrically isolated from the first shield part such that an open space separates the first shield part from the second shield part;

said first shield part comprising at least one cable shield contact located adjacent the socket and adapted to mate electrically with an electromagnetic interference (EMI) shield termination contact of the associated cable termination plug for electrically coupling the first shield part to an EMI shield of the associated cable;

said first and second shield parts further comprising respective first and second shield connector pins adapted to physically and electrically connect the shield with an associated printed circuit board.

2. The shielded connector as set forth in claim 1, wherein the first shield part is located adjacent the socket, and the second shield part is abutted with and covers at least part of the body.

3. The shielded connector as set forth in claim 1, wherein the first and second shield parts are each constructed from a metallic material.

4. The shielded connector as set forth in claim 3, wherein:

the connector body comprises a top wall and a bottom wall, a front wall and a rear wall, and first and second side walls;

the socket opens through the front wall of the connector body; and, the first and second shield parts cover at least 85% of an exposed surface area of the connector body defined by the top wall, the rear wall, and the first and second side walls.

5. The shielded connector as set forth in claim 4, wherein said first shield part covers a portion of the front wall that surrounds an open mouth of the socket and said cable shield contact projects into said socket through said open mouth.

6. The shielded connector as set forth in claim 5, wherein said first shield part further covers a portion of said top wall located adjacent said front wall and covers portions of said first and second side walls located adjacent said front wall.

7. The shielded connector as set forth in claim 4, wherein said body is physically connected to and mounted on a printed circuit board such that said shield connector pins of said first shield part are electrically connected to a first ground path of said printed circuit board and said shield connector pins of said second shield part are electrically connected to a second ground path of said printed circuit board that is different than the first ground path.

8. The shielded connector as set forth in claim 6, wherein said first ground path is a chassis ground path and said second ground path is a logic common connection point.

9. The shielded connector as set forth in claim 6, wherein said second shield part further covers at least part of said bottom wall of said connector body and is located between said bottom wall and said printed circuit board.

10. The shielded connector as set forth in claim 6, wherein said first shield part comprises at least two of said first shield connector pins.

11. The shielded connector as set forth in claim 6, wherein said second shield part comprises at least two of said second shield connector pins.

12. The shielded connector as set forth in claim 1, wherein the plurality of connector contacts located in the socket are respectively operably connected to the plurality of connector pins projecting outwardly from the body by one of: (i) a direct connection; (ii) an isolated network connection.

13. The shielded connector as set forth in claim 1, wherein:

the connector body comprises a top wall and a bottom wall, a front wall and a rear wall, and first and second side walls;

the socket opens through the front wall of the connector body; and, the first and second shield parts cover at least 85% of an exposed surface area of the connector body defined by the top wall, the rear wall, and the first and second side walls.

14. The shielded connector as set forth in claim 13, wherein said first shield part covers a portion of the front wall that surrounds an open mouth of the socket and wherein said first shield part covers a portion of said top wall located adjacent said front wall and covers portions of said first and second side walls located adjacent said front wall.

15. The shielded connector as set forth in claim 14, wherein said body is physically connected to and mounted on a printed circuit board such that said shield connector pins of said first shield part are electrically connected to a first ground path of said printed circuit board and said shield pins of said second shield part are electrically connected to a second ground path of said printed circuit board that is different than the first ground path.

16. The shielded connector as set forth in claim 15, wherein said first ground path is a chassis ground path and said second ground path is a logic common connection point.

17. A shielded connector comprising:

a body connected to a printed circuit board, said body comprising a front wall, a rear wall, a top wall, a bottom wall, a first side wall, and a second side wall, wherein said bottom wall is abutted with said printed circuit board and said body comprises an open socket defined therein that opens through a mouth defined in said front wall, said socket adapted to receive an associated cable termination plug of an associated cable;

a plurality of connector contacts located in the socket and adapted to mate with corresponding contacts of the associated cable termination plug;

a plurality of connector pins projecting outwardly from the body and respectively operably coupled to the plurality of connector contacts, wherein said connector pins are electrically connected to said printed circuit board;

an electrically conductive metallic shield connected to said body, said shield comprising: (i) a first shield part; and (ii) a second shield part that is physically disconnected from the first shield part and that is electrically isolated from the first shield part such that an open space separates the first shield part from the second shield part;

said first shield part located adjacent said mouth of said socket and comprising at least one cable shield contact located adjacent the socket and adapted to mate electrically with an electromagnetic interference (EMI) shield termination contact of the associated cable termination plug for directly electrically coupling the first shield part to an EMI shield of the associated cable;

said second shield part covering at least part of said rear wall, said top wall, and said first and second side walls of said body;

said first and second shield parts further comprising respective first and second shield connector pins connected to the printed circuit board for dissipating electrical charges from said first and second shield parts through the printed circuit board.

18. A shielded connector comprising:

a body comprising a socket including a plurality of connector contacts located in the socket, wherein said socket adapted to receive an associated cable plug and said plurality of connector contacts located in said socket are adapted to mate respectively with a plurality of corresponding plug contacts of the associated cable plug;

a plurality of connector pins projecting outwardly from the body and operably connected to the plurality of connector contacts, respectively;

an electrically conductive metallic shield covering at least part of the body, the shield comprising: (i) a first part; and (ii) a second that is physically disconnected and electrically isolated from the first of the shield such that an open space separates the first part of the shield S from the second part of the shield S;

wherein the first part of the shield is located adjacent the socket, and the second part of the shield is abutted with and covers at least part of the body, and wherein said open space that separates the first and second parts of the shield exposes at least part of said body;

said body comprises opposite front and rear walls, opposite first and second side walls, and opposite top and bottom walls, wherein said socket is defined in said front wall and wherein said open space extends from a first end located adjacent a first intersection where said first side wall intersects said bottom wall to a second end located adjacent a second intersection where said second side wall intersects said bottom wall;

wherein said open space comprises: (i) a first leg that extends from said first end across said first side wall; (ii) a second leg that extends from said first leg across said top wall; and, (iii) a third leg that extends across said second side wall from said second leg to said second end such that said open space extends continuously and uninterruptedly from said first end to said second end; and, wherein the first and third legs are arranged parallel with respect to each other and the first and third legs are each arranged perpendicular to the second leg, and wherein the second leg is arranged parallel to the bottom wall of the body and perpendicular to the first and second side walls of the body.

* * * * *